US011285742B2

(12) United States Patent
Yasuki

(10) Patent No.: US 11,285,742 B2
(45) Date of Patent: Mar. 29, 2022

(54) HALF CUTTER AND TAPE PRINTING APPARATUS

(71) Applicant: SEIKO EPSON CORPORATION, Tokyo (JP)

(72) Inventor: Hirosuke Yasuki, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 152 days.

(21) Appl. No.: 16/880,157

(22) Filed: May 21, 2020

(65) Prior Publication Data

US 2020/0369050 A1 Nov. 26, 2020

(30) Foreign Application Priority Data

May 22, 2019 (JP) ..... JP2019-095802

(51) Int. Cl.
*B41J 11/70* (2006.01)
*B41J 3/407* (2006.01)
*B41J 11/66* (2006.01)

(52) U.S. Cl.
CPC ..... *B41J 11/70* (2013.01); *B41J 3/4075* (2013.01); *B41J 11/66* (2013.01)

(58) Field of Classification Search
CPC . B41J 11/70; B41J 11/66; B41J 11/666; B41J 11/703; B41J 3/4075; G03G 2215/00814; B26D 2001/0066; B26D 1/065
See application file for complete search history.

(56) References Cited

U.S. PATENT DOCUMENTS

| | | | | |
|---|---|---|---|---|
| 5,957,597 | A | 9/1999 | Kato | |
| 2005/0061132 | A1 | 3/2005 | Sodeyama | |
| 2006/0061132 | A1* | 3/2006 | Sua-an | B60J 11/00 296/136.01 |
| 2006/0285898 | A1* | 12/2006 | Watanabe | G03G 21/0017 399/350 |
| 2008/0044200 | A1* | 2/2008 | Okamoto | G03G 15/0812 399/109 |
| 2008/0069622 | A1 | 3/2008 | Sodeyama | |
| 2013/0202342 | A1 | 8/2013 | Kosuge et al. | |
| 2014/0227013 | A1* | 8/2014 | Takahashi | G03G 15/2028 399/323 |
| 2018/0281221 | A1 | 10/2018 | Sugimoto | |

FOREIGN PATENT DOCUMENTS

| | | | |
|---|---|---|---|
| CN | 103241014 | A | 8/2013 |
| CN | 108688350 | A | 10/2018 |
| JP | H11-170638 | A | 6/1999 |
| JP | 2005-059503 | A | 3/2005 |
| JP | 2013-158972 | A | 8/2013 |
| JP | 2018-171697 | A | 11/2018 |

* cited by examiner

*Primary Examiner* — Kristal Feggins
(74) *Attorney, Agent, or Firm* — Oliff PLC

(57) ABSTRACT

A half cutter includes a blade, a blade holder to which the blade is fixed, a blade receiving member which the blade approaches to or departs from, a blade receiving holder to which the blade receiving member is fixed, a spacer which is provided to at least one of the blade and the blade receiving member and generates a gap between the blade and the blade receiving member when the blade approaches the blade receiving member, and a fixing member that fixes the spacer to at least one of the blade holder and the blade receiving holder.

8 Claims, 10 Drawing Sheets

HALF CUTTER AND TAPE PRINTING APPARATUS

The present application is based on, and claims priority from JP Application Serial Number 2019-095802, filed May 22, 2019, the disclosure of which is hereby incorporated by reference herein in its entirety.

BACKGROUND

1. Technical Field

The present disclosure relates to a half cutter that half-cuts an object to be cut and a tape printing apparatus.

2. Related Art

As disclosed in JP-A-11-170638, a half cut apparatus has been known which includes a cutting blade and a receiving table which the cutting blade approaches to or departs from. The receiving table is provided with a pair of step portions that generate a gap between the cutting blade and the receiving table when the cutting blade approaches the receiving table.

In the receiving table of an existing half cut apparatus, the pair of step portions are formed by, for example, press working. However, it is difficult to reduce variation of heights of the step portions. Therefore, when the cutting blade approaches the receiving table, a variation occurs in a dimension of the gap between the cutting blade and the receiving table, so that an object to be cut cannot be appropriately half-cut.

SUMMARY

The half cutter of the present disclosure includes a blade, a blade holder to which the blade is fixed, a blade receiving member which the blade approaches to or departs from, a blade receiving holder to which the blade receiving member is fixed, a spacer which is provided to at least one of the blade and the blade receiving member and generates a gap between the blade and the blade receiving member when the blade approaches the blade receiving member, and a fixing member that fixes the spacer to at least one of the blade holder and the blade receiving holder.

The tape printing apparatus of the present disclosure includes a print head that performs printing on a print tape of a tape including the print tape and a release tape adhered to the print tape and a half cutter that cuts one of the print tape and the release tape without cutting the other tape. The half cutter includes a blade, a blade holder to which the blade is fixed, a blade receiving member which the blade approaches to or departs from, a blade receiving holder to which the blade receiving member is fixed, a spacer which is provided to at least one of the blade and the blade receiving member and generates a gap between the blade and the blade receiving member in a state in which the blade approaches the blade receiving member, and a fixing member that fixes the spacer to at least one of the blade holder and the blade receiving holder.

DESCRIPTION OF EXEMPLARY EMBODIMENTS

Figure 1:
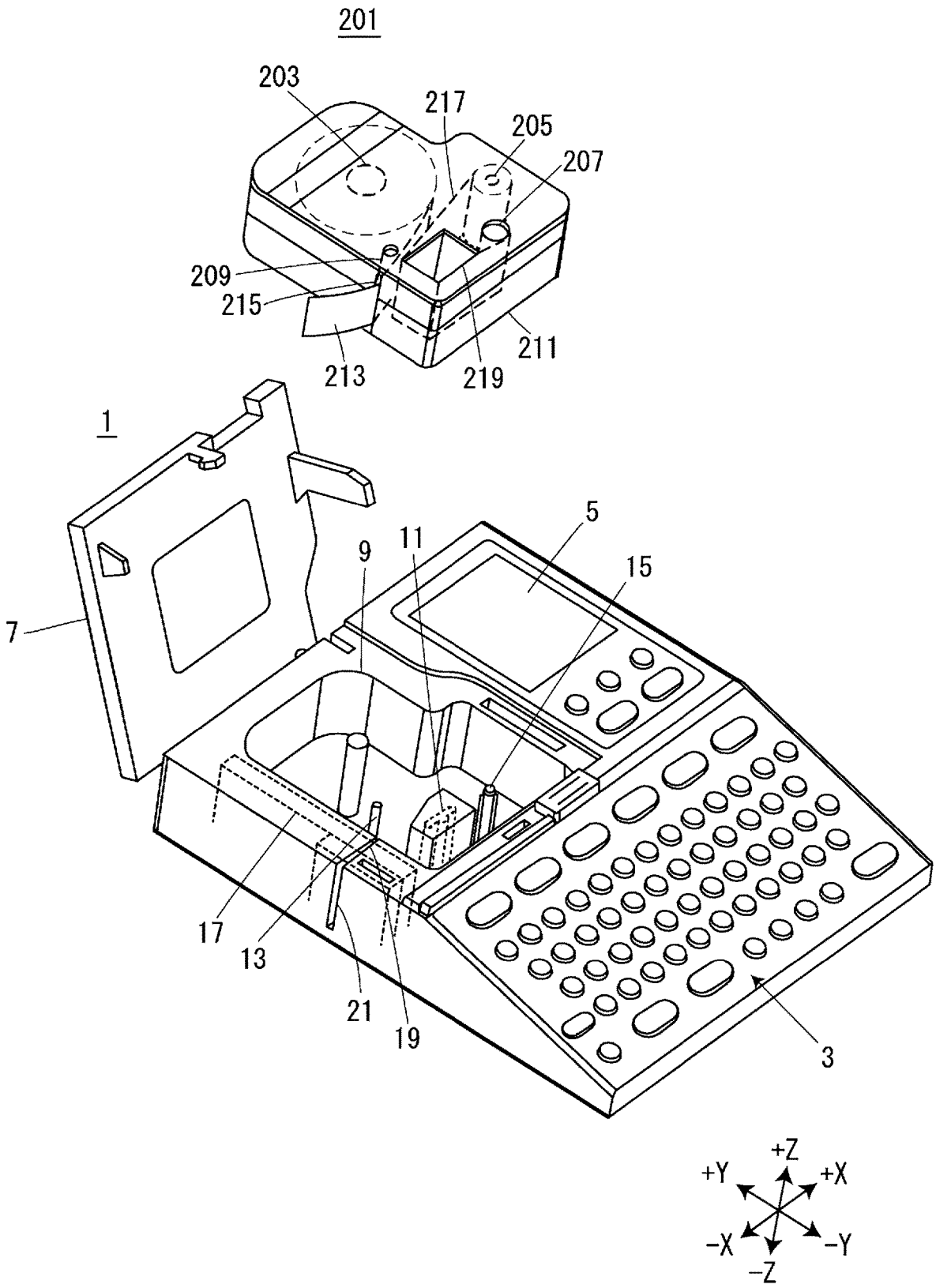
FIG. 1 is a perspective view of a tape printing apparatus and a tape cartridge.

Hereinafter, an embodiment of a half cutter and a tape printing apparatus will be described with reference to the drawings. Although an XYZ coordinate system is shown in the drawings below, the coordinate system is used only for convenience of description and does not limit at all the embodiment described below. Numerical numbers representing the numbers of components and the like are merely examples and do not limit at all the embodiment described below.

Tape Printing Apparatus and Tape Cartridge

As shown in FIG. 1, a tape printing apparatus 1 includes a keyboard 3, a display 5, a mounting section cover 7, a cartridge mounting section 9, a print head 11, a platen shaft 13, a winding shaft 15, and a cutter unit 17.

The keyboard 3 receives print information such as a character string and an input operation of various instructions such as execution of printing. The display 5 displays various information in addition to the print information inputted from the keyboard 3. The mounting section cover 7 opens and closes the cartridge mounting section 9.

The cartridge mounting section 9 is formed into a recessed shape that opens in a +Z direction. A bottom surface of the cartridge mounting section 9 is provided with the print head 11, the platen shaft 13, and the winding shaft 15, which protrude in the +Z direction. The print head 11 is a thermal head including heating elements. A tape cartridge 201 is detachably attached to the cartridge mounting section 9.

Figure 2:
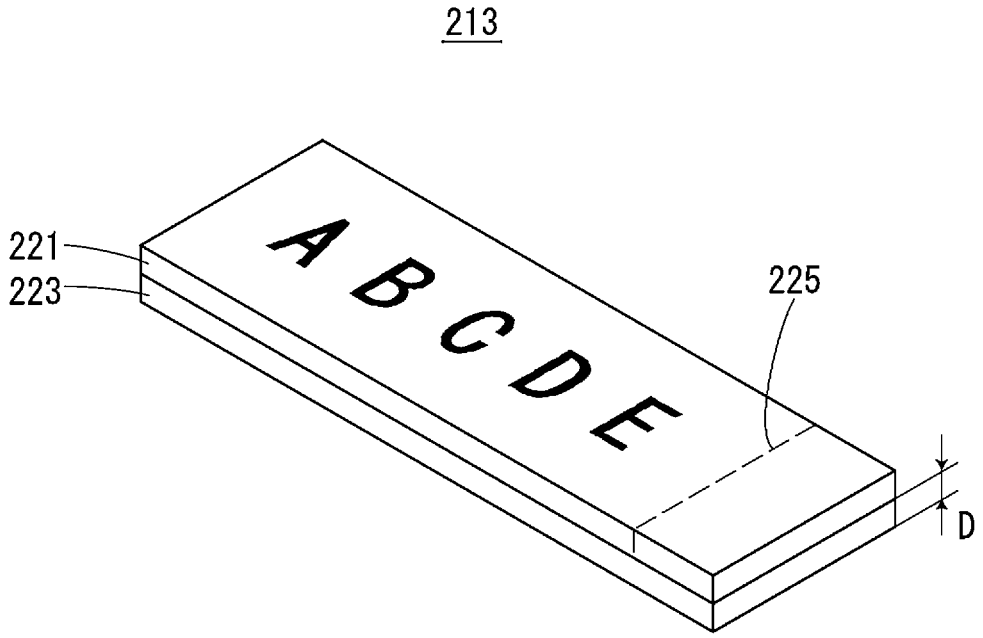
FIG. 2 is a perspective view of a tape where a cut is formed by a half cutter.

The tape cartridge 201 includes a tape core 203, a feeding out core 205, a winding core 207, a platen roller 209, and a cartridge case 211 that houses those mentioned above. A tape 213 is wound around the tape core 203. The tape 213 fed out from the tape core 203 is sent out from a tape delivery port 215 provided on the cartridge case 211 to the outside of the cartridge case 211. The tape 213 is a laminated body including a print tape 221 on which printing is performed by the print head 11 and a release tape 223 peelably adhered to an adhesive surface of the print tape 221 (see FIG. 2). An ink ribbon 217 is wound around the feeding out core 205. The ink ribbon 217 fed out from the feeding out core 205 is wound around the winding core 207. The cartridge case 211 is provided with a head insertion hole 219 penetrating in a Z direction.

When the tape cartridge 201 is mounted in the cartridge mounting section 9, the print head 11, the platen shaft 13, and the winding shaft 15 are inserted into the head insertion hole 219, the platen roller 209, and the winding core 207, respectively. When the mounting section cover 7 is closed in this state, the print head 11 is moved toward the platen shaft 13 by a head moving mechanism not shown in the drawings. Thereby, the tape 213 and the ink ribbon 217 are held between the print head 11 and the platen roller 209. The tape printing apparatus 1 prints the print information inputted from the keyboard 3 or the like on the tape 213 by heating the print head 11 while feeding the tape 213 and the ink ribbon 217 by rotating the platen roller 209. The printed tape 213 is discharged from a tape discharge port 21 to the outside of the tape printing apparatus 1 through a tape discharge path 19.

The cutter unit 17 is provided between the cartridge mounting section 9 and the tape discharge port 21. The cutter unit 17 includes a full cutter (not shown in the drawings) and a half cutter 23 (see FIG. 3). The full cutter fully cuts the tape 213. To fully cut means to cut both the print tape 221 and the release tape 223. The half cutter 23 half-cuts the tape 213. To half-cut means to cut the print tape 221 without cutting the release tape 223. When the half cutter 23 half-cuts the tape 213, a cut 225 (see FIG. 2) is formed in the print tape 221. A user can easily separate the print tape 221 and the release tape 223 by using the cut 225 formed in the print tape 221 as a clue. The half cutter 23 may be configured to cut the release tape 223 without cutting the print tape 221.

Half Cutter

Figure 3:
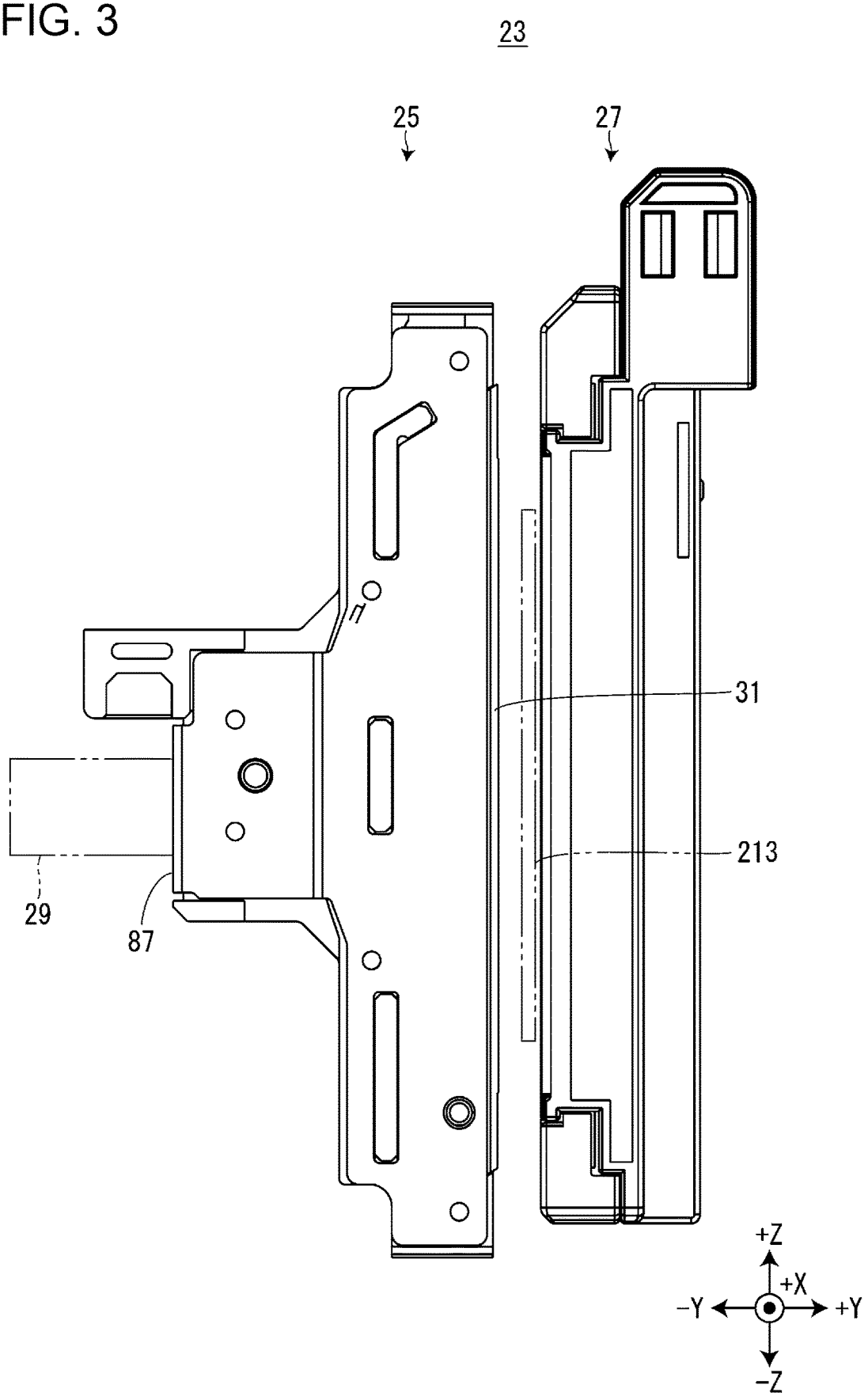
FIG. 3 is a diagram of the half cutter, which is in a state where a movable portion is separated from a receiving portion, as viewed from +X side.
Figure 4:
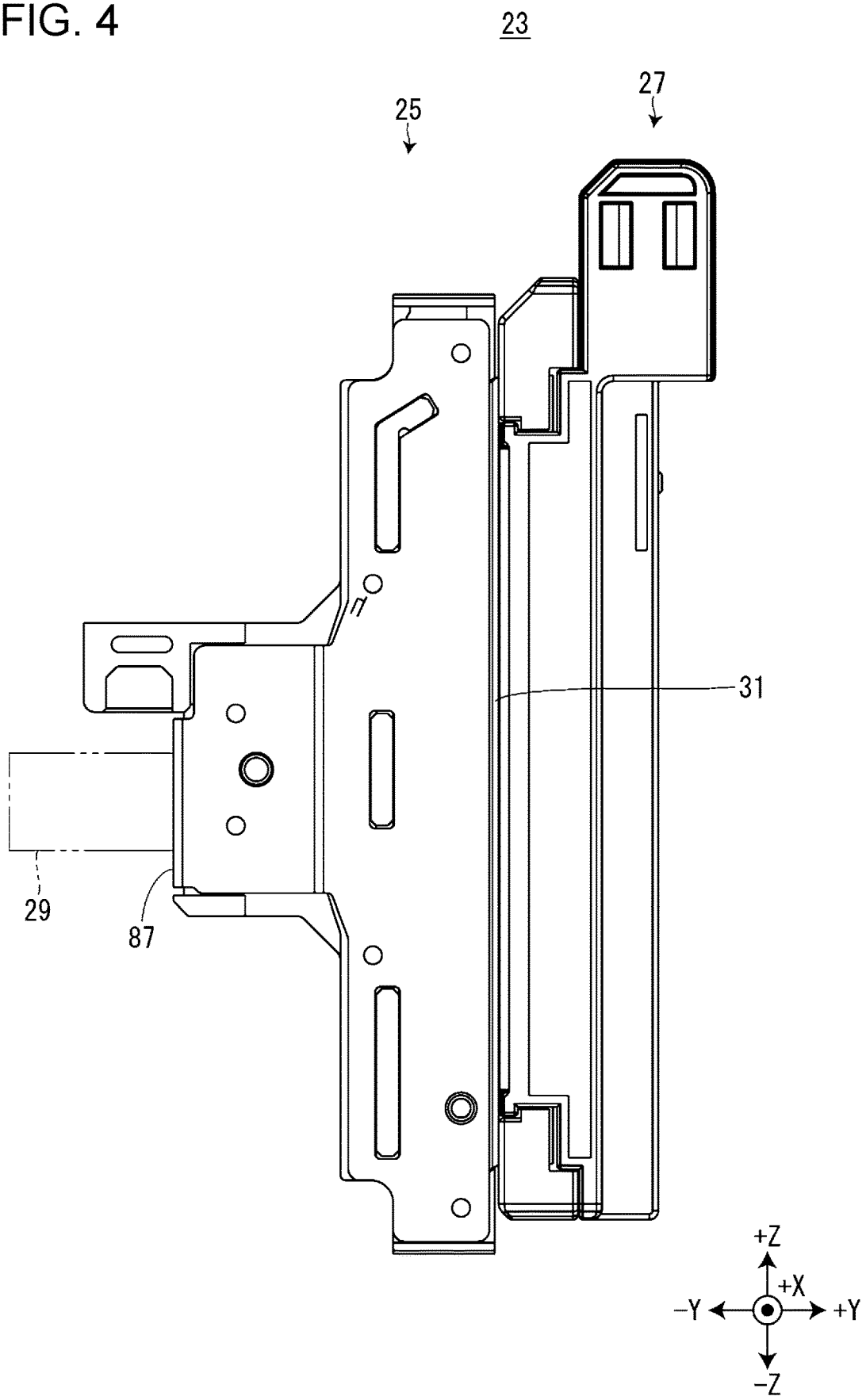
FIG. 4 is a diagram of the half cutter, which is in a state where the movable portion is in contact with the receiving portion, as viewed from +X side.

As shown in FIGS. 3 and 4, the half cutter 23 includes a movable portion 25 including a blade 31, and a receiving portion 27. The movable portion 25 and the receiving portion 27 are provided to face each other while sandwiching the tape 213 fed through the tape discharge path 19. That is, the movable portion 25 is provided on −Y side of the tape discharge path 19 and the receiving portion 27 is provided on +Y side of the tape discharge path 19. The movable portion 25 is moved by a cutter drive mechanism 29 in parallel to a Y direction between a position away from the receiving portion 27 as shown in FIG. 3 and a position in contact with the receiving portion 27 as shown in FIG. 4.

Movable Portion

Figure 5:
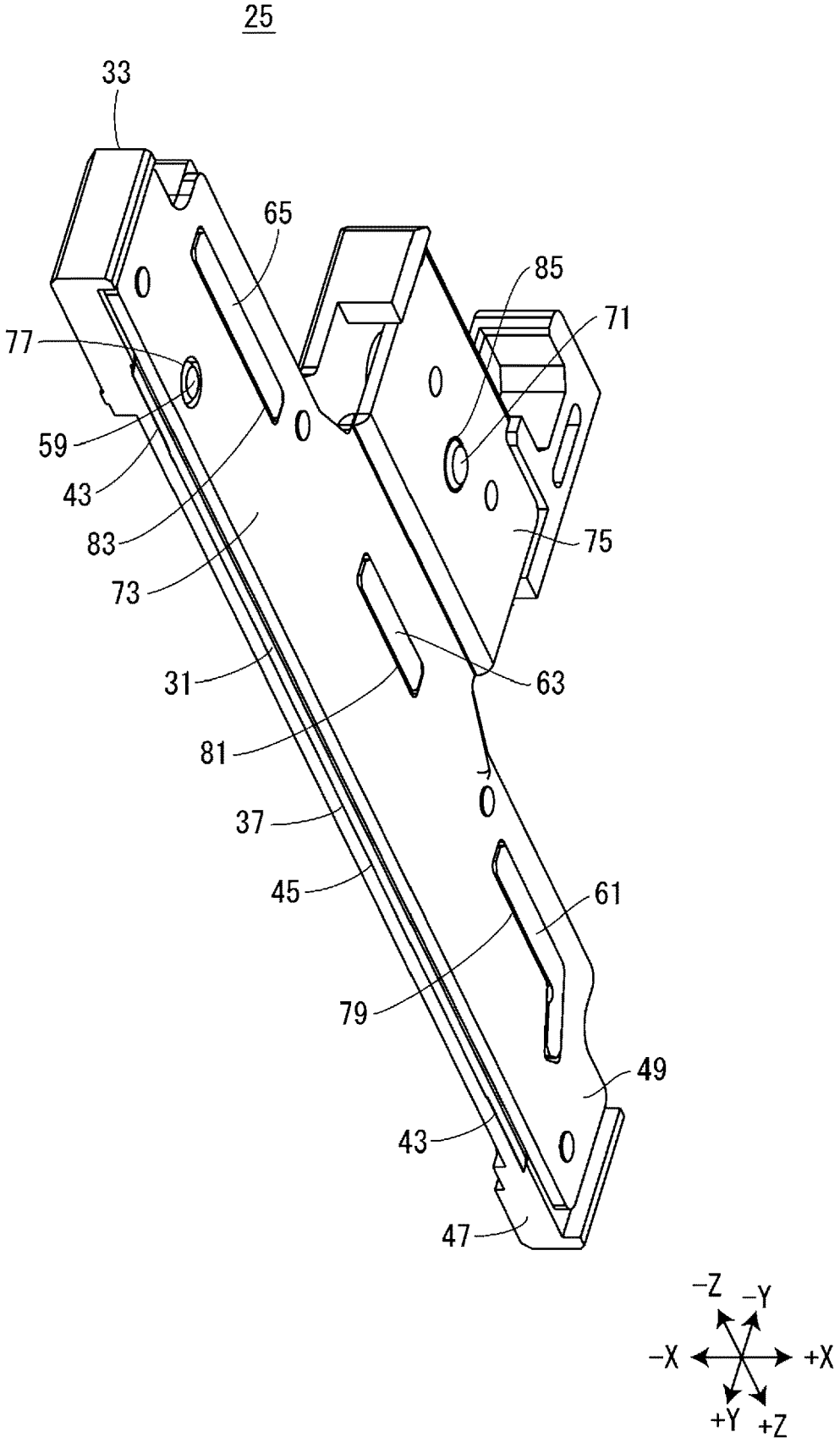
FIG. 5 is a perspective view of the movable portion.
Figure 6:
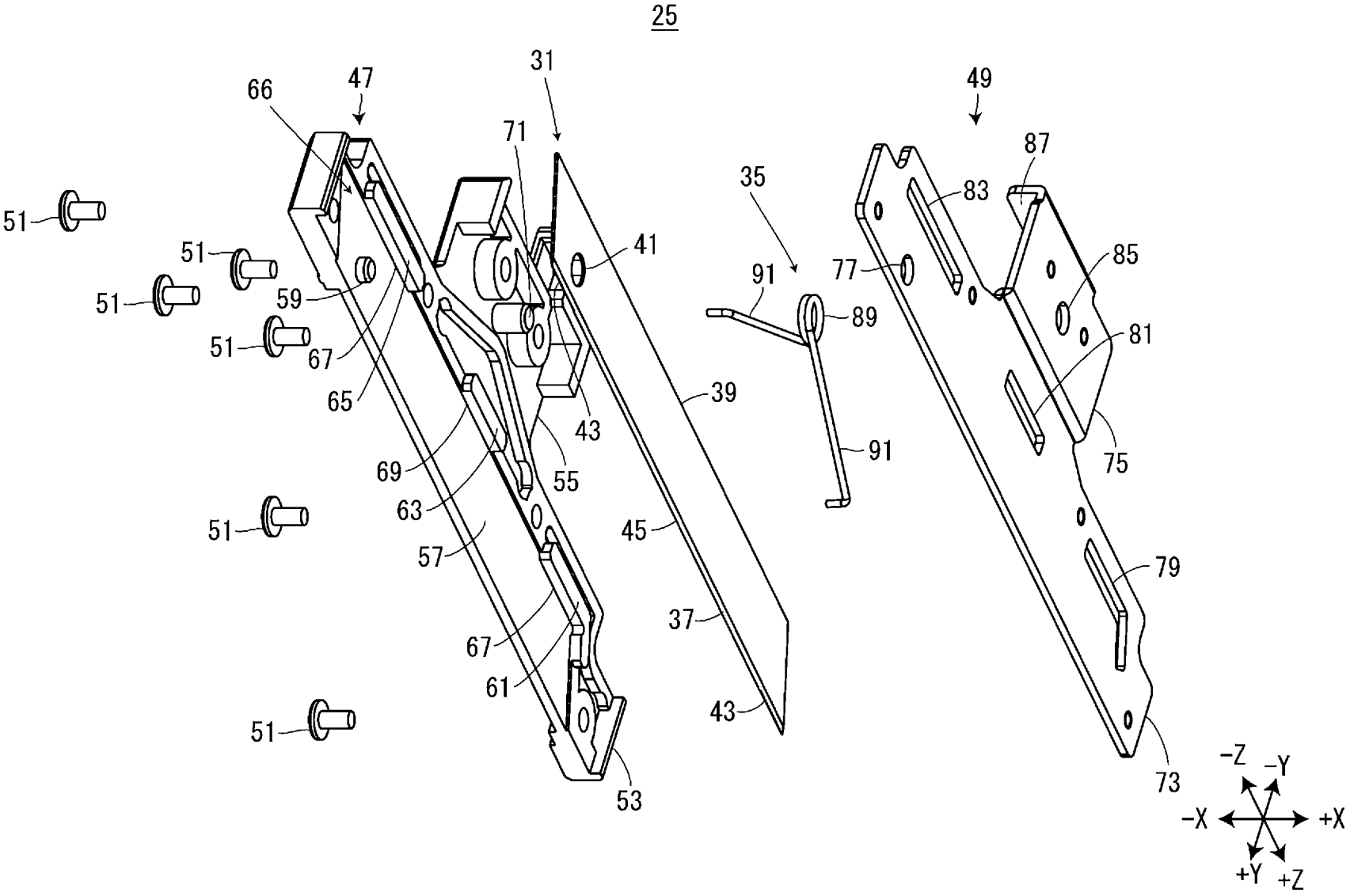
FIG. 6 is an exploded perspective view of the movable portion.
Figure 7:
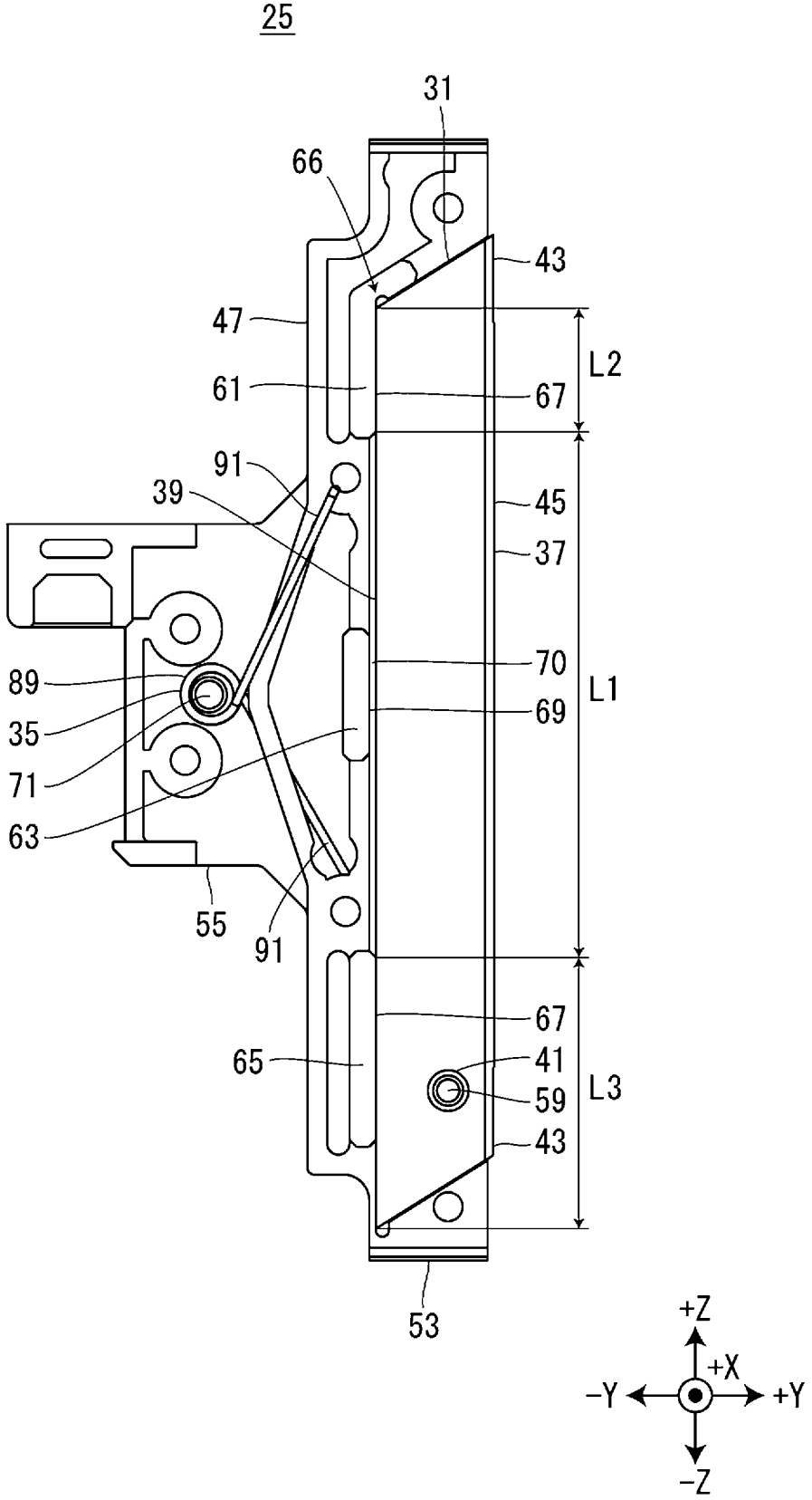
FIG. 7 is a diagram of the movable portion, from which a holder cover is removed, as viewed from +X side.

As shown in FIGS. 5 to 7, the movable portion 25 includes the blade 31, a blade holder 33, and a cutter spring 35. The blade 31 is formed into a plate shape having a substantially parallelogram shape extending in the Z direction. A blade edge 37 is provided on an edge portion on the +Y side of the blade 31. The blade edge 37 is formed into a substantially linear shape and extends in the Z direction. An edge portion of the blade 31 on the −Y side, that is, an edge portion opposite to the blade edge 37 is called a back-sword portion 39. The back-sword portion 39 is formed into a substantially linear shape and extends in the Z direction. A blade mounting hole 41 into which a blade mounting pin 59 is inserted is provided close to a −Z side of the blade 31.

Two scraped portions 43 are provided at both end portions in the extending direction of the blade edge 37, that is, in the Z direction, and a non-scraped portion 45 is provided between the two scraped portions 43. The scraped portion 43 is a portion made by thinning the blade edge 37 by a predetermined thinning dimension A (see FIG. 10) toward the back-sword portion 39 as compared with the non-scraped portion 45. The scraped portion 43 is a portion that comes into contact with a spacer 97 described later without coming into contact with the tape 213 when the half cutter 23 half-cuts the tape 213. The scraped portion 43 is machined into a plane shape so as to be substantially perpendicular to Y axis.

The blade 31 is fixed to the blade holder 33. The blade holder 33 includes a holder main body 47 on −X side and a holder cover 49 on +X side. The blade 31 is provided between the holder main body 47 and the holder cover 49. The holder main body 47 and the holder cover 49 are fixed by a plurality of fixing screws 51. On an end face of the blade holder 33 on the +Y side, the blade edge 37 of the blade 31 protrudes in the +Y side from between the holder main body 47 and the holder cover 49.

The holder main body 47 includes a blade mounting portion 53 and a spring mounting portion 55. The blade mounting portion 53 is formed into a substantially rectangular plate shape extending in the Z direction. A blade mounting recessed portion 57, the blade mounting pin 59, a first fitting protruded portion 61, a second fitting protruded portion 63, and a third fitting protruded portion 65 are provided on a +X side surface of the blade mounting portion 53.

The blade mounting recessed portion 57 is formed into substantially the same shape as the blade 31. A depth of the blade mounting recessed portion 57 is substantially the same as that of the blade 31. The blade 31 is mounted in the blade mounting recessed portion 57. A transmission section 66 is provided on an edge portion on the −Y side of the blade mounting recessed portion 57. Although the details will be described later, the transmission section 66 transmits a pressing force, by which the cutter drive mechanism 29 presses the movable portion 25 against the receiving portion 27, to both end portions of the blade 31 in the extending direction of the blade edge 37.

The transmission section 66 is provided with two engaging portions 67 at both end portions in the Z direction. A non-engaging portion 69 is provided between the two engaging portions 67. The non-engaging portion 69 protrudes toward the −Y side as compared with the two engaging portions 67. Therefore, the engaging portion 67 engages with the back-sword portion 39, and the non-engaging portion 69 does not engage with the back-sword portion 39. As a result, a space 70 is generated between the non-engaging portion 69 and the back-sword portion 39 (see FIG. 7). In the extending direction of the blade edge 37, that is, in the Z direction, a dimension L1 of the non-engaging portion 69 is larger than a total dimension (L2+L3) of the two engaging portions 67.

The blade mounting pin 59 is provided in a substantially cylindrical shape close to the −Z side of the blade mounting recessed portion 57. The blade mounting pin 59 is inserted into the blade mounting hole 41 of the blade 31 and a blade pin insertion hole 77 of the holder cover 49.

The first fitting protruded portion 61, the second fitting protruded portion 63, and the third fitting protruded portion 65 are provided in this order from the +Z side along the edge portion on the −Y side of the blade mounting recessed portion 57. The first fitting protruded portion 61, the second fitting protruded portion 63, and the third fitting protruded portion 65 are respectively fitted into a first fitting opening 79, a second fitting opening 81, and a third fitting opening 83 provided in the holder cover 49. The first fitting protruded portion 61 is provided on the +Z side engaging portion 67 of the −Y side edge portion of the blade mounting recessed portion 57. The first fitting protruded portion 61 extends in the Z direction. A +Z side end portion of the first fitting protruded portion 61 is formed into a shape bending to the +Y side. The second fitting protruded portion 63 is provided on the non-engaging portion 69 of the −Y side edge portion of the blade mounting recessed portion 57. The second fitting protruded portion 63 is formed into a substantially elliptic shape extending in the Z direction as viewed from the +X side to the −X side. The third fitting protruded portion 65 is provided on the −Z side engaging portion 67 of the −Y side edge portion of the blade mounting recessed portion 57. The third fitting protruded portion 65 is formed into a substantially elliptic shape longer than the second fitting protruded portion 63 in the Z direction as viewed from the +X side to the −X side.

The spring mounting portion 55 is continued to the −Y side from a substantially middle portion in the Z direction of a −Y side end portion of the blade mounting portion 53. The spring mounting portion 55 is formed into a substantially rectangular plate shape. The cutter spring 35 is attached to a +X side surface of the spring mounting portion 55. A spring mounting pin 71 is provided in a substantially cylindrical shape at a substantially central portion of the +X side surface of the spring mounting portion 55. A coil portion 89 of the cutter spring 35 is fitted to the spring mounting pin 71 (see FIG. 7).

The holder cover 49 includes a blade cover portion 73 and a spring cover portion 75. The blade cover portion 73 covers the blade mounting portion 53 and the +X side of the blade 31 mounted on the blade mounting portion 53. The blade cover portion 73 is provided with the blade pin insertion hole 77, the first fitting opening 79, the second fitting opening 81, and the third fitting opening 83.

The blade pin insertion hole 77 is provided close to the −Z side of the blade cover portion 73. The blade mounting pin 59 provided on the blade mounting portion 53 is inserted into the blade pin insertion hole 77.

The first fitting opening 79, the second fitting opening 81, and the third fitting opening 83 are provided in this order from the +Z side. The first fitting opening 79, the second fitting opening 81, and the third fitting opening 83 are respectively fitted to the first fitting protruded portion 61, the second fitting protruded portion 63, and the third fitting protruded portion 65 provided on the blade mounting portion 53. The first fitting opening 79, the second fitting opening 81, and the third fitting opening 83 are respectively formed into substantially the same shapes as those of the first fitting protruded portion 61, the second fitting protruded portion 63, and the third fitting protruded portion 65. Specifically, the first fitting opening 79 extends in the Z direction, and a +Z side end portion of the first fitting opening 79 is formed into a shape bending to the +Y side. The second fitting opening 81 is formed into an elliptic shape extending in the Z direction. The third fitting opening 83 is formed into an elliptic shape longer than the second fitting opening 81 in the Z direction.

The spring cover portion 75 covers the spring mounting portion 55 and the +X side of the cutter spring 35 mounted on the spring mounting portion 55. The spring cover portion 75 is provided with a spring pin insertion hole 85 and a pressure receiving portion 87. The spring pin insertion hole 85 is provided at a substantially central portion of the spring cover portion 75. The spring mounting pin 71 provided on the spring mounting portion 55 is inserted into the spring pin insertion hole 85. The pressure receiving portion 87 bends to the −X side from a −Y side end portion of the spring cover portion 75 and is located between the two engaging portions 67 in the Z direction, that is, the extending direction of the blade edge 37. The pressure receiving portion 87 engages with the cutter drive mechanism 29. The pressure receiving portion 87 is a portion that receives a pressing force by which the cutter drive mechanism 29 presses the movable portion 25 against the receiving portion 27 in a state in which the movable portion 25 is in contact with the receiving portion (see FIG. 4).

The cutter spring 35 is mounted to the spring mounting portion 55. Specifically, the coil portion 89 of the cutter spring 35 is fitted to the spring mounting pin 71. Although not shown in the drawings, two arm portions 91 of the cutter spring 35 are hooked to two spring hook portions provided on a holder support portion that supports the blade holder 33 movably in the Y direction. The cutter spring 35 applies a force on the blade holder 33 in a direction opposite to the receiving portion 27, that is, in the −Y direction. Therefore, when the blade holder 33 is pressed to the +Y side by the cutter drive mechanism 29, the blade holder 33 moves to the +Y side until hitting the receiving portion 27. When the cutter drive mechanism 29 moves to the −Y side, the blade holder 33 is moved to the −Y side by the cutter spring 35 and is separated from the receiving portion 27. For example, a torsion coil spring can be used as the cutter spring 35.

In the movable portion 25 configured as described above, the pressing force received by the pressure receiving portion 87 in a state in which the movable portion 25 is in contact with the receiving portion 27 is transmitted to the two engaging portions 67 and the non-engaging portion 69 provided on the transmission section 66 through the first fitting protruded portion 61, the second fitting protruded portion 63, and the third fitting protruded portion 65 that are respectively fitted into the first fitting opening 79, the second fitting opening 81, and the third fitting opening 83. Here, as described above, both end portions of the back-sword portion 39 in the extending direction of the blade edge 37 engage with the two engaging portions 67, and a middle portion of the back-sword portion 39 in the extending direction of the blade edge 37 does not engage with the non-engaging portion 69.

Therefore, the pressing force received by the pressure receiving portion 87 is restrained from being transmitted from the non-engaging portion 69 to a middle portion of the blade 31 in the extending direction of the blade edge 37, and the pressing force is transmitted from the two engaging portions 67 to both end portions of the blade 31 in the extending direction of the blade edge 37. In other words, the transmission section 66 transmits the pressing force received by the pressure receiving portion 87 to both end portions of the blade 31 in the extending direction of the blade edge 37. Thereby, the pressing force received by the pressure receiving portion 87 is restrained from being intensively transmitted to the middle portion of the blade 31 in the extending direction of the blade edge 37. That is, the pressing force transmitted to the blade 31 is equalized in the extending direction of the blade edge 37. Therefore, it is possible to restrain a cutting depth of the half cutter 23 from becoming large in a middle portion in the width direction of the tape 213 and becoming small in both end portions in the width direction of the tape 213. Thus, when the tape 213 is half-cut by the half cutter 23, both end portions in the width direction of the print tape 221 are restrained from being insufficiently cut, and it is possible to appropriately form the cut 225 in the print tape 221.

Further, the non-engaging portion 69 is provided on the blade holder 33, so that it is possible to increase an appropriate pressing force range, that is, a range of the pressing force by which the tape 213 is appropriately half-cut by the half cutter 23. Specifically, the non-engaging portion 69 is provided on the blade holder 33, so that although a lower limit value of the appropriate pressing force range increases as compared with a configuration in which the non-engaging portion 69 is not provided, an upper limit value of the appropriate pressing force range increases by more than the amount of increase of the lower limit value. Thereby, it is possible to suppress miss-cut by the half cutter 23. Specifically it is possible to suppress the print tape 221 from being not cut because the pressing force received by the pressure receiving portion 87 becomes less than the appropriate pressing force range and it is possible to suppress not only the print tape 221 but also the release tape 223 from being cut because the pressing force received by the pressure receiving portion 87 exceeds the appropriate pressing force range.

Receiving Portion

Figure 8:
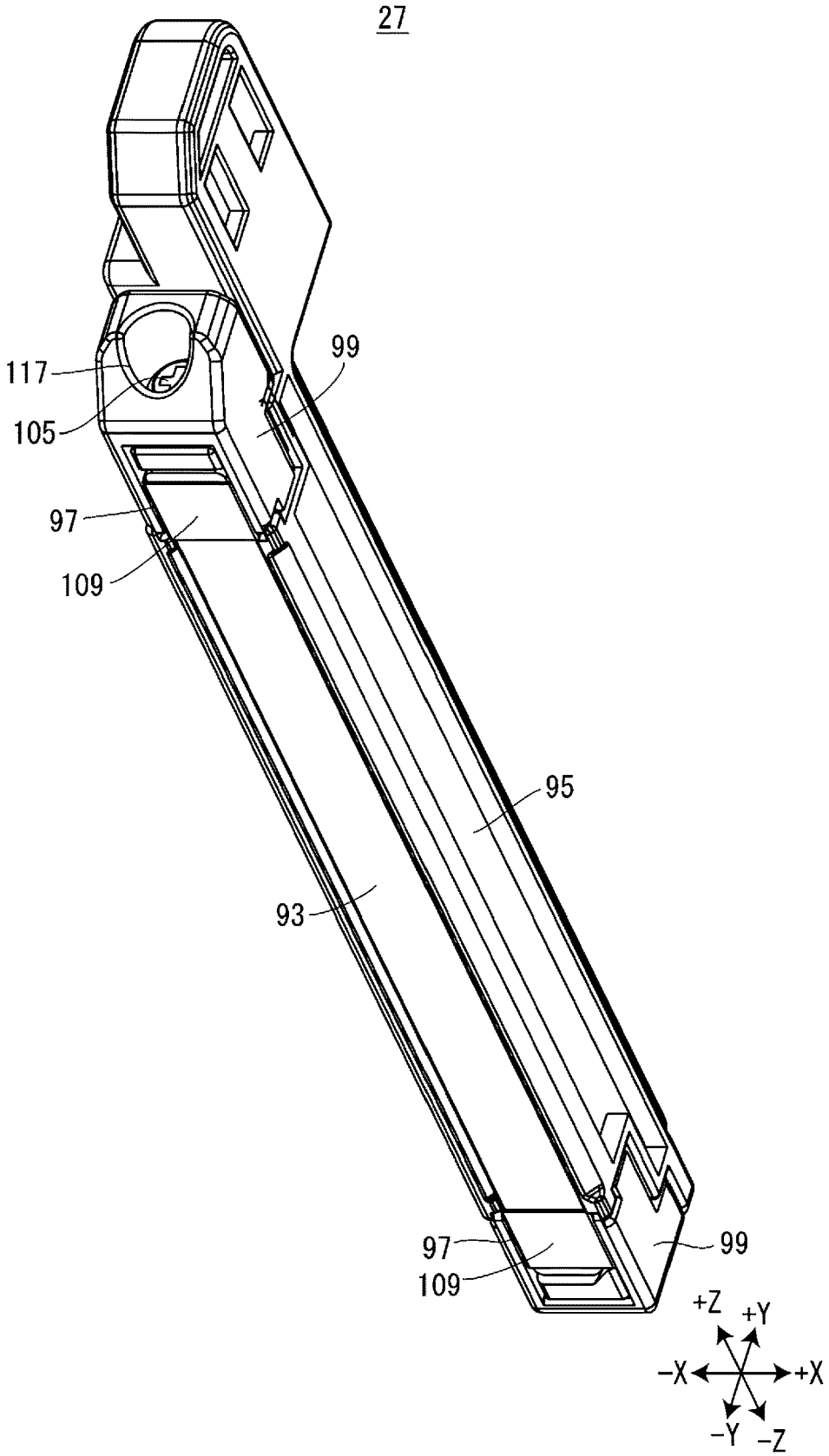
FIG. 8 is a perspective view of the receiving portion.
Figure 9:
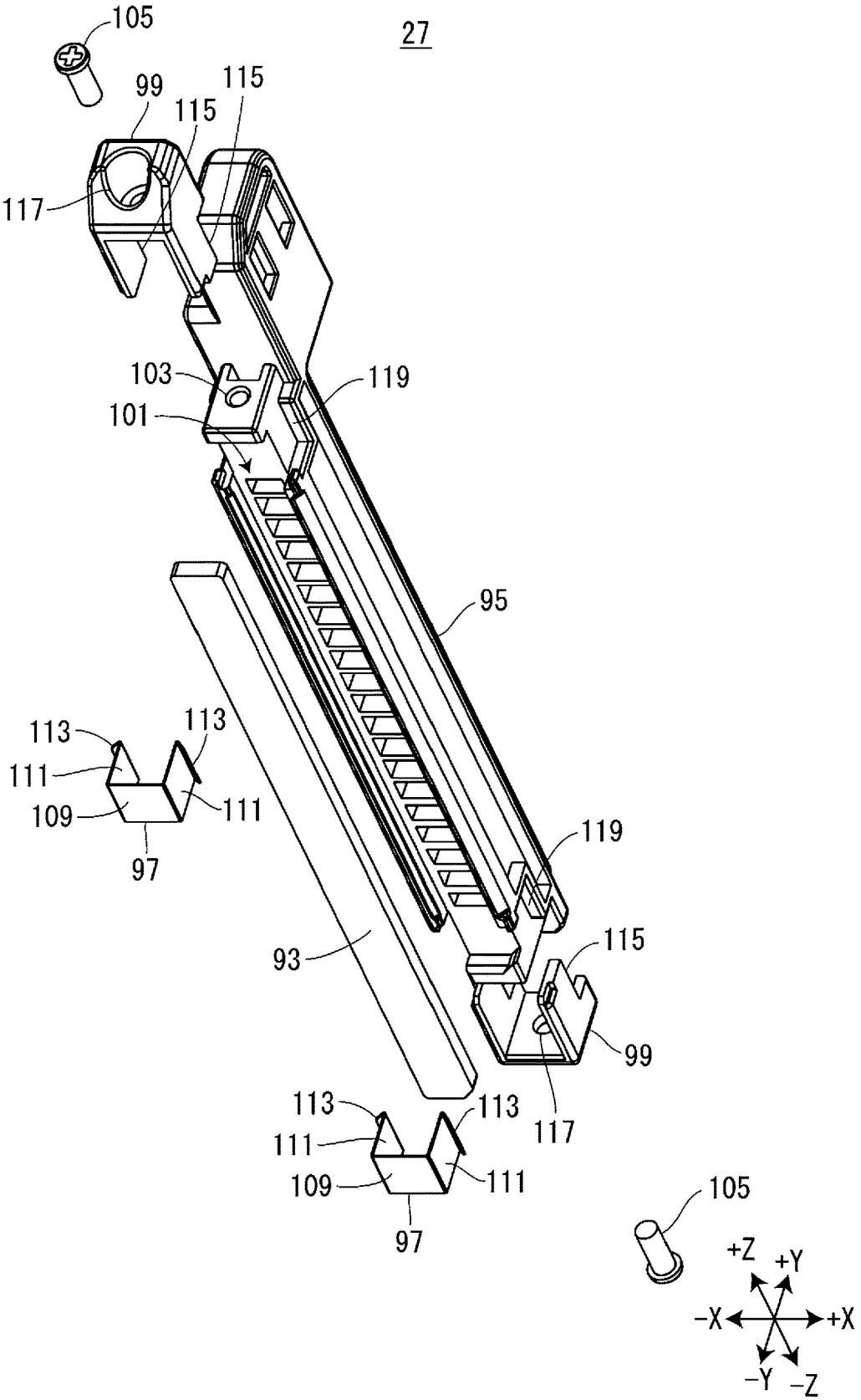
FIG. 9 is an exploded perspective view of the receiving portion.

As shown in FIGS. 8 and 9, the receiving portion 27 includes a blade receiving member 93, a blade receiving holder 95, two spacers 97, and two fixing members 99.

The blade receiving member 93 is formed into a substantially rectangular plate shape elongated in the Z direction. The blade 31 approaches to or departs from the blade receiving member 93. Specifically, the blade receiving member 93 receives the blade 31 moving to the +Y side through the spacer 97. Here, the "approaches to or departs from" means "comes close to or separates from".

The blade receiving member 93 is fixed to the blade receiving holder 95. The blade receiving holder 95 is provided with a blade receiving recessed portion 101 and two screw holes 103. The blade receiving recessed portion 101 is provided on a −Y side surface of the blade receiving holder 95. The blade receiving member 93 is attached to the blade receiving recessed portion 101. The two screw holes 103 are provided to both end portions in the Z direction of the blade receiving holder 95. A blade receiving fixing screw 105 is screwed to the screw hole 103.

The two spacers 97 are provided at both end portions in the Z direction of the blade receiving member 93. When the blade 31 approaches the blade receiving member 93, the spacer 97 generates a gap 107 between the blade edge 37 of the blade 31 and a −Y side surface of the blade receiving member 93 (see FIG. 10). Specifically, when the blade 31 approaches the blade receiving member 93, the scraped portion 43 of the blade edge 37 abuts on the spacer 97 and the gap 107 is generated between the non-scraped portion 45 of the blade edge 37 and the blade receiving member 93 between the two spacers 97.

Figure 10:
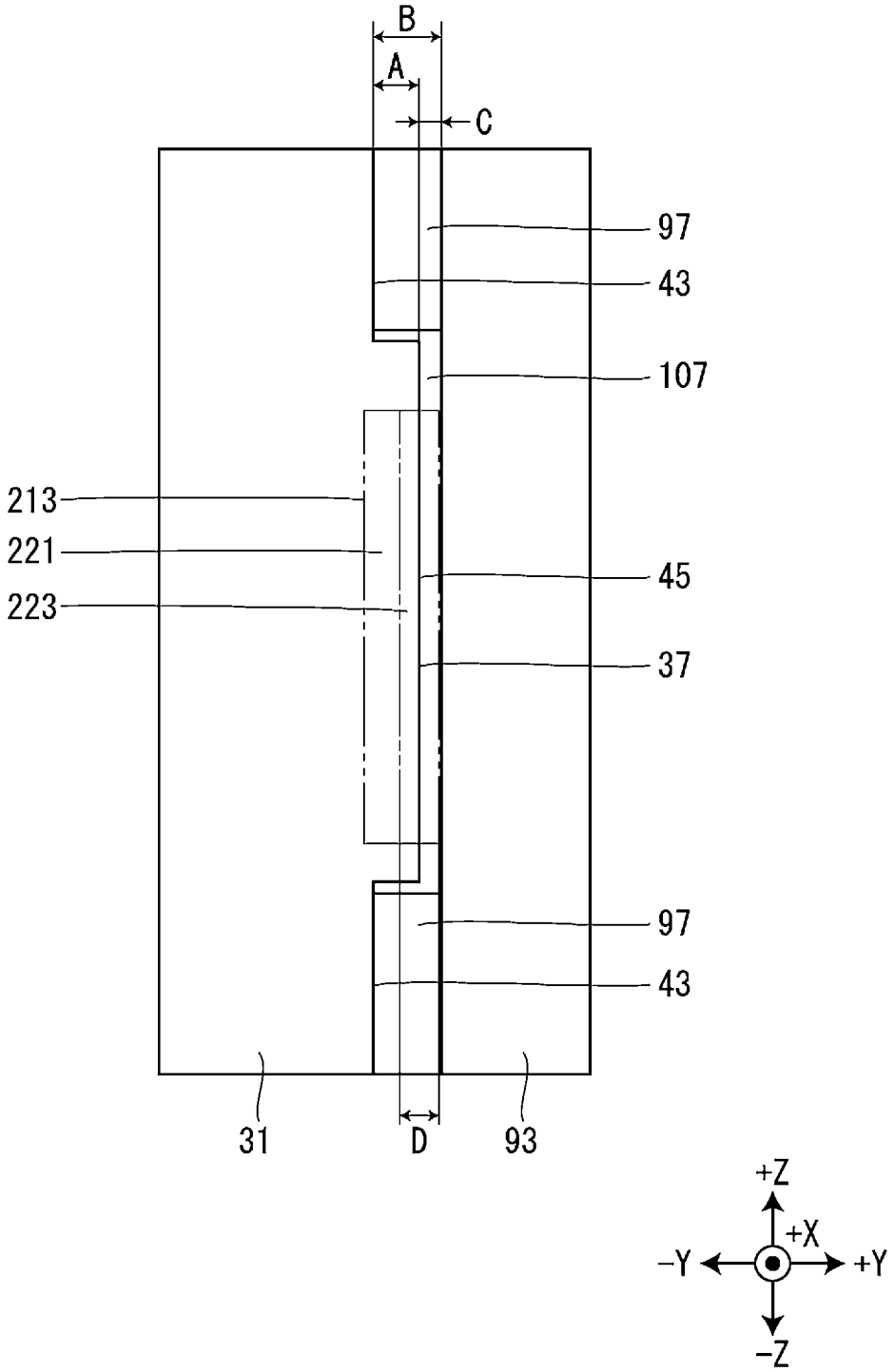
FIG. 10 is a diagram for explaining a thickness of a spacer.

The scraped portion 43 is provided to the blade edge 37, and accordingly a thickness B of the spacer 97 can be increased (see FIG. 10). Further, as described above, the scraped portion 43 is machined into a plane shape. Therefore, when the scraped portion 43 hits the spacer 97, the spacer 97 is restrained from being cut.

The spacer 97 is formed by, for example, folding a substantially rectangular metallic plate-like member. The spacer 97 includes an abutting portion 109, two bent portions 111, and two elastic portions 113. The abutting portion 109 faces the scraped portion 43. When the blade 31 approaches the blade receiving member 93, the scraped portion 43 abuts on the abutting portion 109. The two bent portions 111 are bent to the +Y side from both end portions in the X direction of the abutting portion 109. The two elastic portions 113 are bent diagonally from +Y side end portions of the two bent portions 111 to the −Y side so as to be away from each other.

For example a shim sheet can be used as the spacer 97. For the spacer 97, a shim sheet of an appropriate thickness B is used from among shim sheets whose thicknesses B are different. As shown in FIG. 10, as the spacer 97, a shim sheet of the thickness B greater than the thinning dimension A of the scraped portion 43 is selected. A dimension C of the gap 107 between the blade 31 and the blade receiving member 93 corresponds to a difference obtained by subtracting the thinning dimension A of the scraped portion 43 from the thickness B of the spacer 97, so that a shim sheet of the thickness B where the difference is smaller than a tape thickness D of the release tape 223 is selected. Specifically, for example, when the thinning dimension A of the scraped portion 43 is 0.1 mm and the tape thickness D of the release tape 223 is 0.07 mm, a shim sheet whose thickness B is smaller than 0.17 mm is used as the spacer 97. Shim sheets whose thicknesses B are different by units smaller than a dimension tolerance of the thinning dimension A of the scraped portion 43 are sold, and a dimension tolerance of the thickness B of the shim sheet is also small. Therefore, it is possible to obtain an appropriate dimension C of the gap 107 by absorbing variations of the thinning dimension A of the scraped portion 43 by using the spacer 97 whose thickness B varies according to the thinning dimension A of the scraped portion 43.

As described later, the spacer 97 is fixed to the blade receiving holder 95 by the fixing member 99 without using adhesive. Therefore, the abutting portion 109 is in contact with the −Y side surface of the blade receiving member 93 not through adhesive. Thereby, there is no influence of the thickness of adhesive, so that it is possible to suppress occurrence of variation in the dimension C of the gap 107. Further, the spacer 97 can be easily replaced because no adhesive is used.

The two fixing members 99 are attached to both end portions in the Z direction of the blade receiving holder 95 and fix the spacers 97 to the blade receiving holder 95. The fixing member 99 includes two pressing portions 115 and a screw insertion hole 117. The two pressing portions 115 press the two elastic portions 113 of each spacer 97 against press receiving portions 119 provided to the blade receiving holder 95 to the +Y side in a state in which the fixing members 99 are attached to the blade receiving holder 95. The blade receiving fixing screw 105 is inserted into the screw insertion hole 117.

Here, an assembly method of the receiving portion 27 will be described. First, the blade receiving member 93 is incorporated into the blade receiving recessed portion 101. Subsequently, both end portions in the Z direction of the blade receiving member 93 are covered with the two spacers 97. In this state, the two fixing members 99 are attached to both end portions in the Z direction of the blade receiving holder 95 by the blade receiving fixing screws 105. At this time, the pressing portion 115 of the fixing member 99 elastically deforms the elastic portion 113 to the +Y side, so that the pressing portion 115 that receives an elastic force from the elastic portion 113 presses the spacer 97 to the +Y side, that is, to a moving direction of the blade 31, by a reaction force of the elastic force. Thereby, the position of the spacer 97 is determined in the moving direction of the blade 31, so that it is possible to suppress occurrence of variation in the dimension C of the gap 107 between the blade 31 and the blade receiving member 93. The spacer 97 is fixed to the blade receiving holder 95, so that the blade receiving member 93 is held between the spacer 97 and the blade receiving holder 95, and thereby the blade receiving member 93 can be fixed to the blade receiving holder 95.

As described above, according to the half cutter 23 of the present embodiment, when the blade 31 approaches the blade receiving member 93, the gap 107 is generated between the blade 31 and the blade receiving member 93 by the spacer 97 that is fixed to the blade receiving holder 95 by the fixing member 99, so that it is possible to suppress occurrence of variation in the dimension C of the gap 107 between the blade 31 and the blade receiving member 93. Therefore, the tape 213 can be appropriately half-cut.

Further, according to the half cutter 23 of the present embodiment, the pressing force received by the pressure receiving portion 87 is transmitted to both end portions of the blade 31 in the extending direction of the blade edge 37 by the transmission section 66. Thereby, it is possible to restrain a cutting depth of the half cutter 23 from becoming large in a middle portion in the width direction of the tape 213 and becoming small in both end portions in the width direction of the tape 213. In other words, it is possible to suppress variation in the cutting depth of the half cutter 23 in the width direction of the tape 213, that is, in the extending direction of the blade edge 37 of the blade 31.

Other Modified Examples

The present disclosure is not limited to the embodiment described above, and various configurations can be employed without departing from the scope of the disclosure. For example, the embodiment described above can be modified to forms as described below.

The spacer 97 is not limited to being provided to the blade receiving member 93 and fixed to the blade receiving holder 95 by the fixing member 99, but may be provided to the blade 31 and fixed to the blade holder 33 by the fixing member 99. Further, one of the two spacers 97 may be provided to the blade receiving member 93 and fixed to the blade receiving holder 95 by the fixing member 99, and the other may be provided to the blade 31 and fixed to the blade holder 33 by the fixing member 99.

The movable portion 25 is not limited to moving in parallel and thereby approaching to or departing from the receiving portion 27, but may rotate around a rotating axis and thereby approaches to or departs from the receiving portion 27.

An object to be cut by the half cutter 23 is not limited to the tape 213 but may be another laminated body.

It is possible to employ a configuration in which the embodiment and the modified examples described above are combined.

APPENDIX

Hereinafter, an appendix for the half cutter and the tape printing apparatus will be described.

The half cutter includes a blade, a blade holder to which the blade is fixed, a blade receiving member which the blade approaches to or departs from, a blade receiving holder to which the blade receiving member is fixed, a spacer which is provided to at least one of the blade and the blade receiving member and generates a gap between the blade and the blade receiving member when the blade approaches the blade receiving member, and a fixing member that fixes the spacer to at least one of the blade holder and the blade receiving holder.

According to this configuration, when the blade approaches the blade receiving member, the gap is generated between the blade and the blade receiving member by the spacer that is fixed to the blade receiving holder by the fixing member, so that it is possible to suppress occurrence of variation in a dimension of the gap between the blade and the blade receiving member.

In this case, it is preferable that the spacer is provided to the blade receiving member and the fixing member fixes the spacer to the blade receiving holder.

According to this configuration, the spacer is more restrained from being bent at a sharp angle as compared with a configuration in which the spacer is provided to the blade, so that the thickness of the spacer is restrained from varying due to approaching of the blade. Therefore, it is possible to more effectively suppress occurrence of variation in the dimension of the gap between the blade and the blade receiving member.

In this case, it is preferable that the spacer has an elastic portion that can be elastically deformed and the fixing member presses the spacer in a moving direction of the blade by a reaction force of an elastic force from the elastic portion.

According to this configuration, the position of the spacer is determined in the moving direction of the blade, so that it is possible to more effectively suppress occurrence of variation in the dimension of the gap between the blade and the blade receiving member.

In this case, it is preferable that an end portion of the blade receiving member is held between the spacer and the blade receiving holder and thereby the blade receiving member is fixed to the blade receiving holder.

According to this configuration, it is not necessary to provide a member for fixing the blade receiving member to the blade receiving holder in addition to the fixing member, so that the number of components can be reduced.

In this case, it is preferable that the blade edge of the blade is provided with a non-scraped portion and a scraped portion that is scraped toward a back-sword portion of the blade as compared with the non-scraped portion and the scraped portion of the blade edge hits the spacer when the blade approaches the blade receiving member.

According to this configuration, the spacer can be restrained from being cut when the blade approaches the blade receiving member.

In this case, it is preferable that the thickness of the spacer is larger than a thinning dimension of the scraped portion.

According to this configuration, it is possible to appropriately form a gap between the blade and the blade receiving member.

In this case, it is preferable that the spacer is in contact with the blade receiving member not through adhesive.

According to this configuration, there is no influence of the thickness of adhesive, so that it is possible to suppress occurrence of variation in the dimension of the gap between the blade and the blade receiving member.

The tape printing apparatus includes a print head that performs printing on a print tape of a tape including the print tape and a release tape adhered to the print tape, and a half cutter that cuts one of the print tape and the release tape without cutting the other tape. The half cutter includes a blade, a blade holder to which the blade is fixed, a blade receiving member which the blade approaches to or departs from, a blade receiving holder to which the blade receiving member is fixed, a spacer which is provided to at least one of the blade and the blade receiving member and generates a gap between the blade and the blade receiving member in a state in which the blade approaches the blade receiving member, and a fixing member that fixes the spacer to at least one of the blade holder and the blade receiving holder.

According to this configuration, when the blade approaches the blade receiving member, the gap is generated between the blade and the blade receiving member by the spacer that is fixed to the blade receiving holder by the fixing member, so that it is possible to suppress occurrence of variation in a dimension of the gap between the blade and the blade receiving member. Therefore, the tape can be appropriately half-cut.

What is claimed is:

1. A half cutter comprising:

a blade;

a blade holder to which the blade is fixed;

a blade receiving member which the blade approaches to or departs from;

a blade receiving holder to which the blade receiving member is fixed;

a spacer which is provided to at least one of the blade and the blade receiving member and generates a gap between the blade and the blade receiving member when the blade approaches the blade receiving member; and a fixing member that fixes the spacer to at least one of the blade holder and the blade receiving holder.

2. The half cutter according to claim 1, wherein the spacer is provided to the blade receiving member, and the fixing member fixes the spacer to the blade receiving holder.

3. The half cutter according to claim 2, wherein the spacer has an elastic portion that can be elastically deformed, and the fixing member presses the spacer in a moving direction of the blade by a reaction force of an elastic force from the elastic portion.

4. The half cutter according to claim 2, wherein an end portion of the blade receiving member is held between the spacer and the blade receiving holder and thereby the blade receiving member is fixed to the blade receiving holder.

5. The half cutter according to claim 2, wherein a blade edge of the blade is provided with a non-scraped portion and a scraped portion that is scraped toward a back-sword portion of the blade as compared with the non-scraped portion, and the scraped portion of the blade edge hits the spacer when the blade approaches the blade receiving member.

6. The half cutter according to claim 5, wherein a thickness of the spacer is larger than a thinning dimension of the scraped portion.

7. The half cutter according to claim 2, wherein the spacer is in contact with the blade receiving member not through adhesive.

8. A tape printing apparatus comprising:

a print head that performs printing on a print tape of a tape including the print tape and a release tape adhered to the print tape; and a half cutter that cuts one of the print tape and the release tape without cutting the other tape, wherein the half cutter includes a blade, a blade holder to which the blade is fixed, a blade receiving member which the blade approaches to or departs from, a blade receiving holder to which the blade receiving member is fixed, a spacer which is provided to at least one of the blade and the blade receiving member and generates a gap between the blade and the blade receiving member in a state in which the blade approaches the blade receiving member, and a fixing member that fixes the spacer to at least one of the blade holder and the blade receiving holder.

* * * * *